US008734041B2

(12) United States Patent
Hermouet

(10) Patent No.: US 8,734,041 B2
(45) Date of Patent: May 27, 2014

(54) DISPENSER OF PRODUCT

(75) Inventor: Yannic Hermouet, Saran (FR)

(73) Assignee: Parfums Christian Dior, Paris (FR)

( * ) Notice: Subject to any disclaimer, the term of this patent is extended or adjusted under 35 U.S.C. 154(b) by 325 days.

(21) Appl. No.: 13/262,483

(22) PCT Filed: Mar. 30, 2010

(86) PCT No.: PCT/FR2010/050587
§ 371 (c)(1),
(2), (4) Date: Sep. 30, 2011

(87) PCT Pub. No.: WO2010/112756
PCT Pub. Date: Oct. 7, 2010

(65) Prior Publication Data

US 2012/0027499 A1 Feb. 2, 2012

(30) Foreign Application Priority Data

Apr. 3, 2009 (FR) ..... 09 52219

(51) Int. Cl.
*B43K 23/00* (2006.01)

(52) U.S. Cl.
USPC ..... 401/98; 401/102; 132/316; 132/318

(58) Field of Classification Search
USPC ..... 401/98, 99, 102, 107, 109–112, 131, 401/262; 132/316, 318; 206/385
See application file for complete search history.

(56) References Cited

U.S. PATENT DOCUMENTS

| | | | | |
|---|---|---|---|---|
| 1,890,068 | A * | 12/1932 | Schall | 132/316 |
| 2,039,323 | A | 5/1936 | Lessin | |
| 2,485,161 | A * | 10/1949 | Pampinella et al. | 132/316 |
| 2,522,403 | A * | 9/1950 | Ross | 132/316 |
| 2,919,019 | A * | 12/1959 | Curry | 401/98 |
| 5,174,310 | A * | 12/1992 | Galbraith et al. | 132/316 |
| 7,429,140 | B2 * | 9/2008 | Demellier | 401/98 |
| 7,753,608 | B2 * | 7/2010 | Hsing | 401/60 |
| 7,841,794 | B2 * | 11/2010 | Salciarini et al. | 401/98 |
| 7,874,753 | B2 * | 1/2011 | Domy et al. | 401/99 |
| 8,353,636 | B2 * | 1/2013 | Drugeon et al. | 401/107 |
| 2004/0221866 | A1 | 11/2004 | Greenfield | |

FOREIGN PATENT DOCUMENTS

| | | | |
|---|---|---|---|
| DE | 819 445 | C | 10/1951 |
| EP | 1 466 539 | A1 | 10/2004 |
| FR | 37 688 | E | 1/1931 |
| GB | 2 143 804 | A | 2/1985 |
| WO | WO 2008/097002 | A1 | 8/2008 |

OTHER PUBLICATIONS

French Search Report for related French Application No. 09 52219, report dated Jan. 20, 2010.
International Search Report for related international application No. PCT/FR2010/050587, report dated Sep. 30, 2010.

* cited by examiner

*Primary Examiner* — David Walczak
*Assistant Examiner* — Jennifer C Chiang
(74) *Attorney, Agent, or Firm* — Miller, Matthias & Hull LLP

(57) ABSTRACT

The invention relates to a dispenser including: an applicator device; a case comprising a housing for receiving at least a portion of the applicator device; a mobile member being movable mounted inside the housing between a retracted position and a use position; an actuating member for urging the mobile member towards the use position, wherein the housing comprises an abutment surface for engaging with the mobile member in order to define the use position of said mobile member.

9 Claims, 12 Drawing Sheets

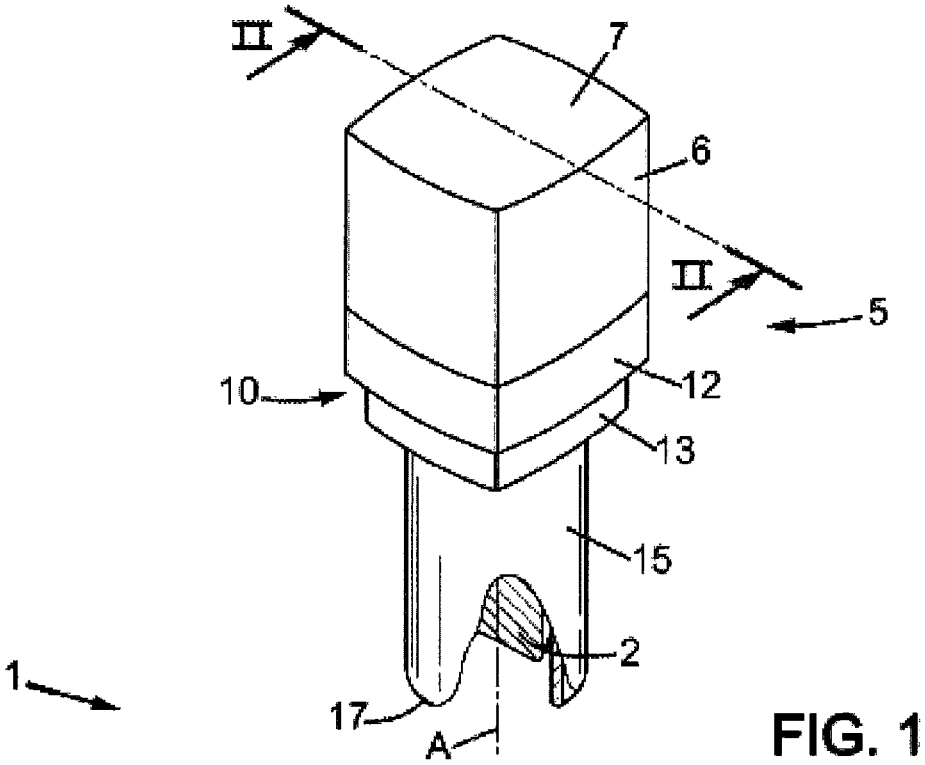
FIG. 1
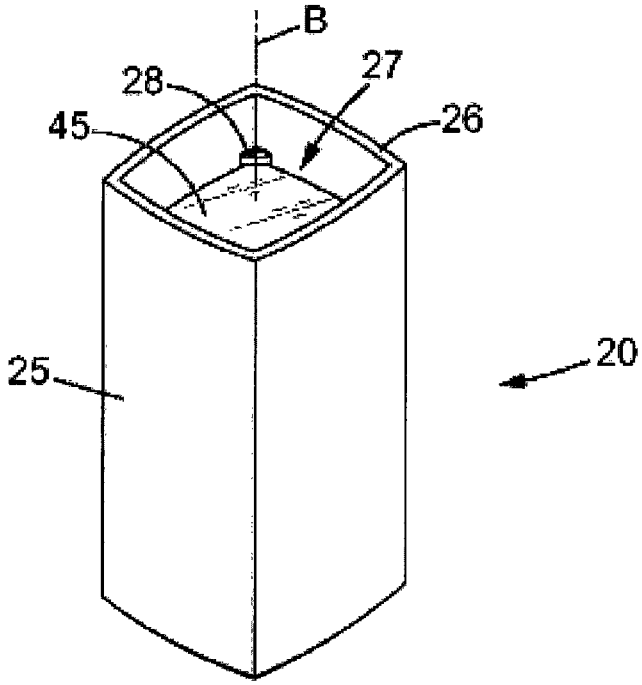

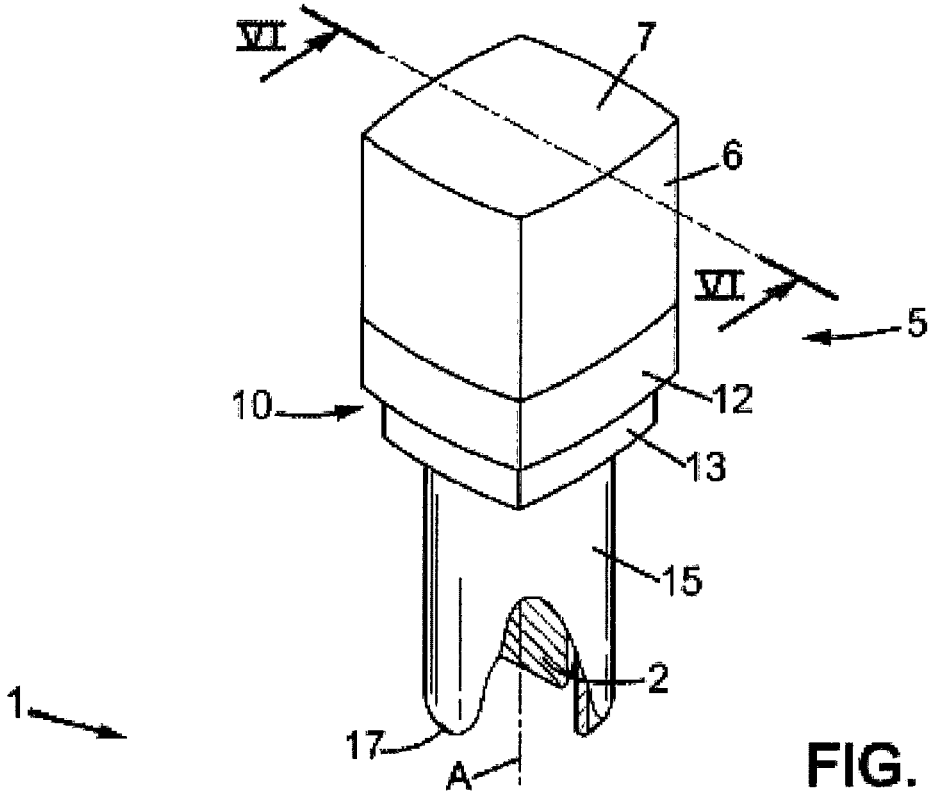
FIG. 5
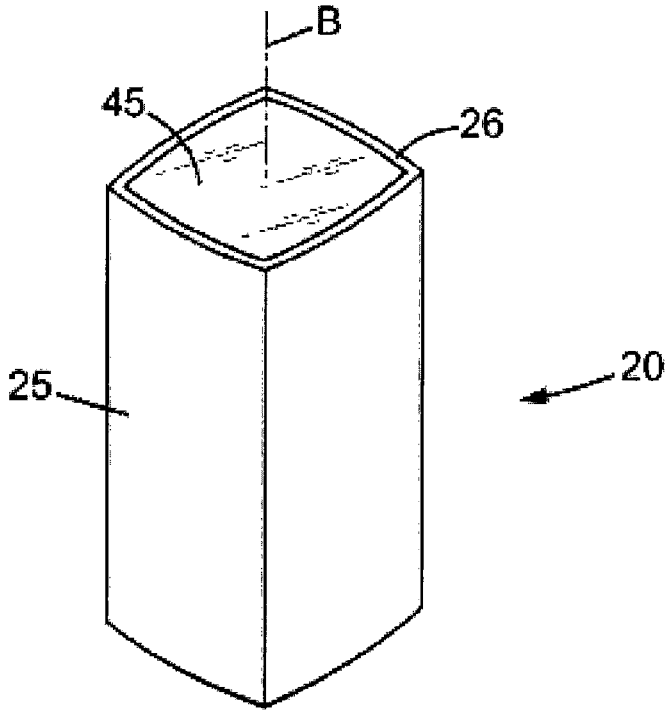

FIG. 7
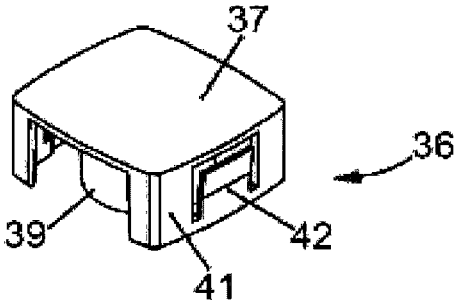
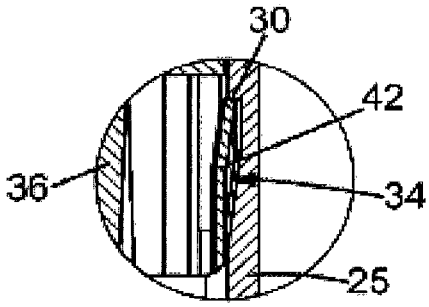
FIG. 9
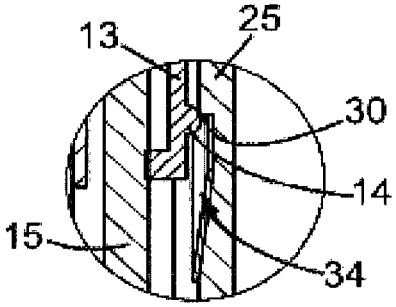
FIG. 10

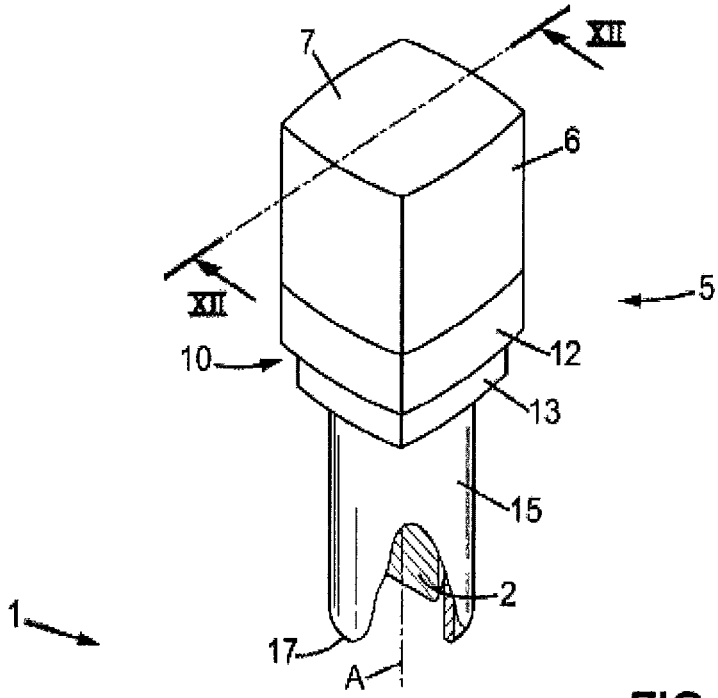
FIG. 11
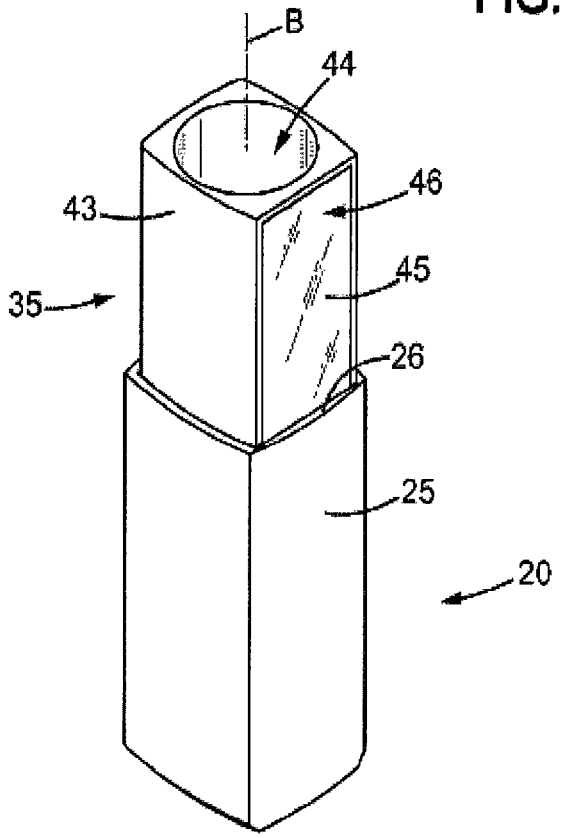

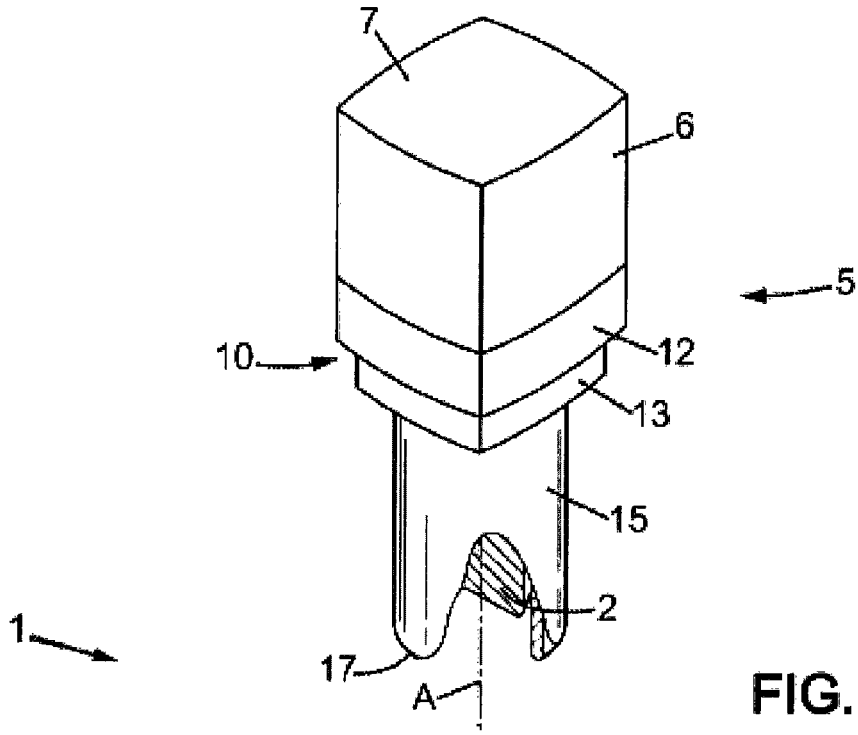
FIG. 13
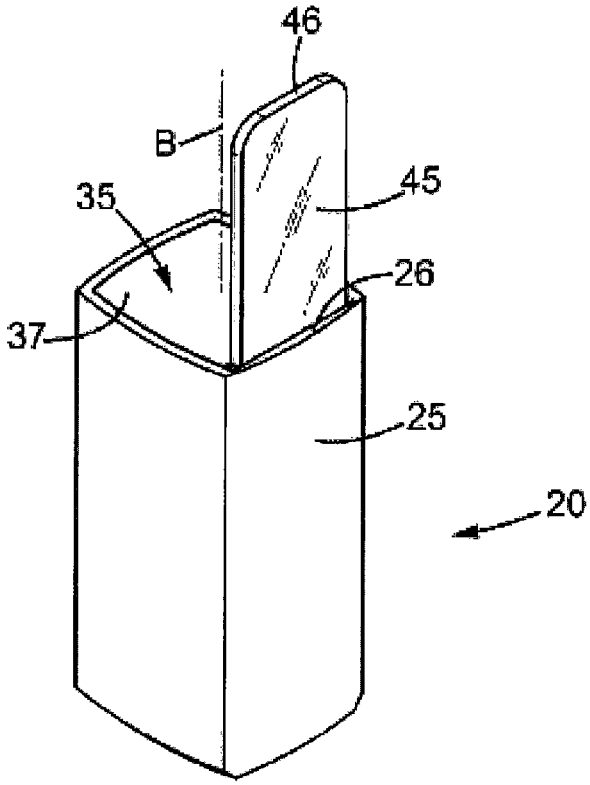

DISPENSER OF PRODUCT

CROSS-REFERENCE TO RELATED APPLICATIONS

This application is a U.S. national stage filing of International Patent Application No. PCT/FR2010/050587 filed on Mar. 30, 2010, which claims priority under the Paris Convention to French Patent Application No. 09 52219, filed on Apr. 3, 2009.

FIELD OF THE DISCLOSURE

The invention relates to a dispenser of product.

BACKGROUND OF THE DISCLOSURE

In particular, the invention relates to a dispenser of product, particularly for cosmetics (such as lipstick), comprising:

an applicator device suitable for applying said product, a case comprising a housing that extends longitudinally along a central axis between a closed bottom and an opening for access to the housing opposite the bottom, said housing being suitable for receiving at least a portion of the applicator device, a mobile member provided with a mirror, the mobile member being movably mounted inside the housing along the central axis between a retracted position, in which said mobile member is close to the bottom, and a position of use, in which said mobile member is apart from the bottom, an actuating member (such as an elastic member) mounted between the bottom of the case and the mobile member, suitable for urging the mobile member towards the position of use.

A dispenser of product of this type is disclosed in document U.S. Pat. No. 2,485,161.

However, the known dispenser does not provide satisfactory control of the position of use, in particular over time.

The invention aims to overcome the problem mentioned above.

SUMMARY OF THE DISCLOSURE

To this end, the invention proposes a dispenser of product of the aforementioned type in which the housing comprises an abutment surface suitable for cooperating with the mobile member in order to define the position of use of said mobile member.

The position of use defined in this way remains the same each time the dispenser is used, throughout the lifetime of the dispenser. This results in improved control of the position of use, particularly over time.

Moreover, according to particular provisions, as the position of use is defined by the abutment surface, the actuating member, for example in the form of an elastic member, can perform the sole function of returning the mobile member to the position of use. The mounting constraints of the actuating member can therefore be made less stringent, which simplifies the assembly of the dispenser.

Furthermore, by acting on the positioning of the abutment surface, the visibility of the mirror can be optimised in a simple manner.

The abutment surface can for example be arranged substantially transversely relative to the central axis so as to be in contact with the mobile member in the position of use.

Moreover, the actuating member can be suitable for urging the mobile member in the position of use against the abutment surface.

Moreover, the case can comprise a tubular side wall delimiting the housing transversely relative to the central axis.

In one embodiment, the case can then comprise inwardly at least one stop protruding from the side wall, said stop containing the abutment surface.

In another embodiment, the case can comprise inwardly at least one recess formed on the side wall, said recess containing the abutment surface.

To ensure that the applicator device is locked to the case when the case is placed on the applicator device to cover it, provision can be made for the applicator device to comprise a securing element suitable for clicking into the recess when the applicator device is received in the housing in the case.

To ensure that the mobile member is guided and moves smoothly in the housing, the mobile member can comprise at least one guide element configured so that it is in contact with an inner surface of the case and in contact with the abutment surface in the position of use of the mobile member.

In particular, the guide element can be an elastically deformable tab extending along the central axis towards the opening to a free end in contact with the inner surface of the case, said free end being in contact with the abutment surface in the position of use of the mobile member.

In one embodiment, the mirror can extend perpendicular to the central axis.

In another embodiment, the mirror can extend parallel to the central axis. The mobile member can then comprise a support having a receiving space that extends along the central axis, said receiving space being open on the side of the opening of the case to receive the applicator device. The support has an outer surface holding the mirror.

The dispenser according to the invention is particularly suitable for applying a solid or paste product designed to be applied to the lips in the context of cosmetic or pharmaceutical use.

In a particular application of the dispenser, the applicator device comprises a cosmetic product for the care and/or make-up of the lips, particularly a lipstick.

Generally, the dispenser according to the invention can be used when the operator needs to see the area intended to receive the product contained in the applicator device. In the cosmetics field, the dispenser according to the invention can also be used to apply an under-eye concealer to the eye contour.

BRIEF DESCRIPTION OF THE DRAWINGS

Further objectives and advantages of the invention will become apparent on reading the following description, given with reference to the attached drawings, in which:

FIG. 1 is a perspective view of a lipstick according to a first embodiment of the invention, the lipstick comprising an applicator device partly cut away to show the lipstick stick, and a removable case in which a mirror is mounted, FIG. 5 is a perspective view of the lipstick according to a second embodiment, the applicator device being partly cut away to show the lipstick stick, FIG. 7 is a perspective view of a support holding the mirror in the lipstick in FIG. 5, FIG. 9 is an enlarged view of the detail marked IX in FIG. 8, FIG. 10 is an enlarged view of the detail marked X in FIG. 6, FIG. 11 is a perspective view of the lipstick according to a third embodiment, the applicator device being partly cut away to show the lipstick stick, FIG. 13 is a perspective view of the lipstick according to a variant of the lipstick in FIG. 11, the applicator device being partly cut away to show the lipstick stick.

DETAILED DESCRIPTION OF THE DISCLOSURE

Figure 2:
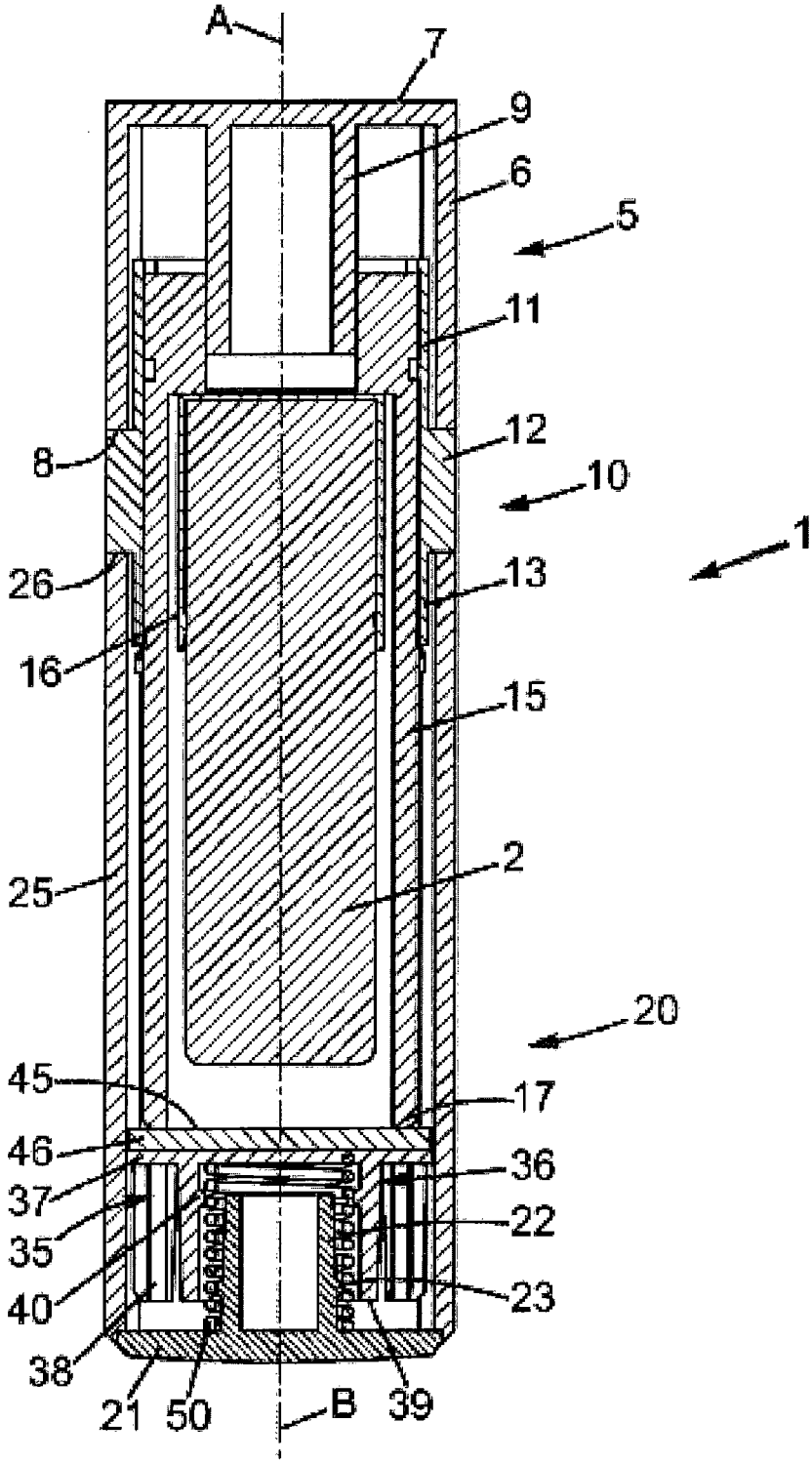
FIG. 2 is a cross-sectional view along the line marked II-II in FIG. 1 of the lipstick in FIG. 1, showing the case placed on the applicator device and the mirror in a retracted position.

In the figures, the same references denote identical or similar components.

FIGS. 1 to 15 show a dispenser 1 comprising:

- an applicator device comprising a solid or paste product intended to be applied in particular to part of the face of a user in the context of cosmetic or pharmaceutical use,
- a case 20 that can be movably positioned coaxially on the applicator device in order to at least partly cover it, and
- a mobile member 35 provided with a mirror 46 having a reflective surface 45, which mobile member 35 is movably mounted inside the case to enable the user to see the part of the face to which the product is to be applied.

For illustrative purposes, the rest of the description refers to a lipstick stick as the product contained in the applicator device.

Moreover, in this application, by the term mirror is meant generally any solid component comprising a flat or substantially flat polished surface capable of reflecting light rays, so that the user can distinguish the image reflected by such surface.

The reflective surface is a surface capable of reproducing an image visible to the user by reflecting incident light. For example, the reflective surface can be obtained by vacuum deposition of a metallic layer directly on the mobile member 35, a plastic film coated with such a layer and bonded to the mobile member 35, or a polished metal plate, typically made from aluminium.

Advantageously, in the embodiments described, the mirror is a conventional glass mirror, for example flat.

In a first embodiment, shown in FIGS. 1 and 2, the applicator device extends along an axis A and comprises a base 5, a sheath 15 mounted on the base 5 and a cup 16, also known as a shell, mounted on the sheath 15.

The base 5 has a tubular side wall 6 with a rectangular cross-section extending from a rectangular transverse wall 7 to a free edge 8. The side wall 6 surrounds a tubular sleeve 9 centred on the axis A of the applicator device and extending from the transverse wall 7.

In the embodiment shown, the applicator device comprises a tubular ferrule 10 having a central portion 12 that tops the free edge 8 of the base 5 so that the outer surface of the central portion 12 is flush with the outer surface of the base 5. In particular, the ferrule 10 comprises two narrow portions 11, 13 arranged on either side of the central portion 12 relative to the axis A of the applicator device. One of the narrow portions 11 is fitted into the base 5, the other narrow portion 13 forming a fitting portion onto which the case 20 can be fitted. In a variant, the fitting portion could be made directly on the side wall 6 of the base 5.

The sheath 15 is tubular with a circular cross-section and extends between an end fitted onto the sleeve 9 of the base 5 so that it can pivot about the axis A of the applicator device, and a free end 17.

The cup 16 is mounted sliding inside the sheath 15 and is configured to receive the lipstick stick 2.

In a manner known per se, the applicator device comprises coupling components, for example in the form of grooves and stubs, arranged on the base 5, the sheath 15 and the cup 16 so that rotating the sheath 15 relative to the base 5 along the axis A of the applicator device causes the translation of the cup 16 along the axis A of the applicator device.

The lipstick stick 2 placed on the cup 16 can thus be moved between a storage position, in which it is entirely housed in the sheath 15, and an application position, in which it protrudes relative to the free end 17 of the sheath.

In FIGS. 1 and 2, the case 20 is cylindrical along a central axis B and comprises a bottom 21 and a side wall 25.

The bottom 21 comprises a rectangular transverse wall relative to the central axis B, and an annular guide skirt 22 that extends from the transverse wall along the central axis B. The outside of the guide skirt has an annular retaining bead 23. In the first embodiment, the bottom 21 is a separate piece and secured in an appropriate manner to one end of the side wall 25.

The side wall 25 is tubular with a rectangular cross-section and extends along the central axis B from the bottom 21 to a free edge 26. The side wall 25 and the bottom 21 have inner surfaces that delimit a housing 27 suitable for coaxially receiving a portion of the applicator device, the free edge 26 of the side wall 25 delimiting an opening for access to the housing 27.

In the embodiment shown, provision is made for the housing 27 to receive the portion of the applicator device made up of the fitting portion 13 and a portion of the sheath 15. In other embodiments, the housing 27 could receive other portions of the applicator device or the entire applicator device, with means of extracting the applicator device being provided in the latter case.

Figure 3:
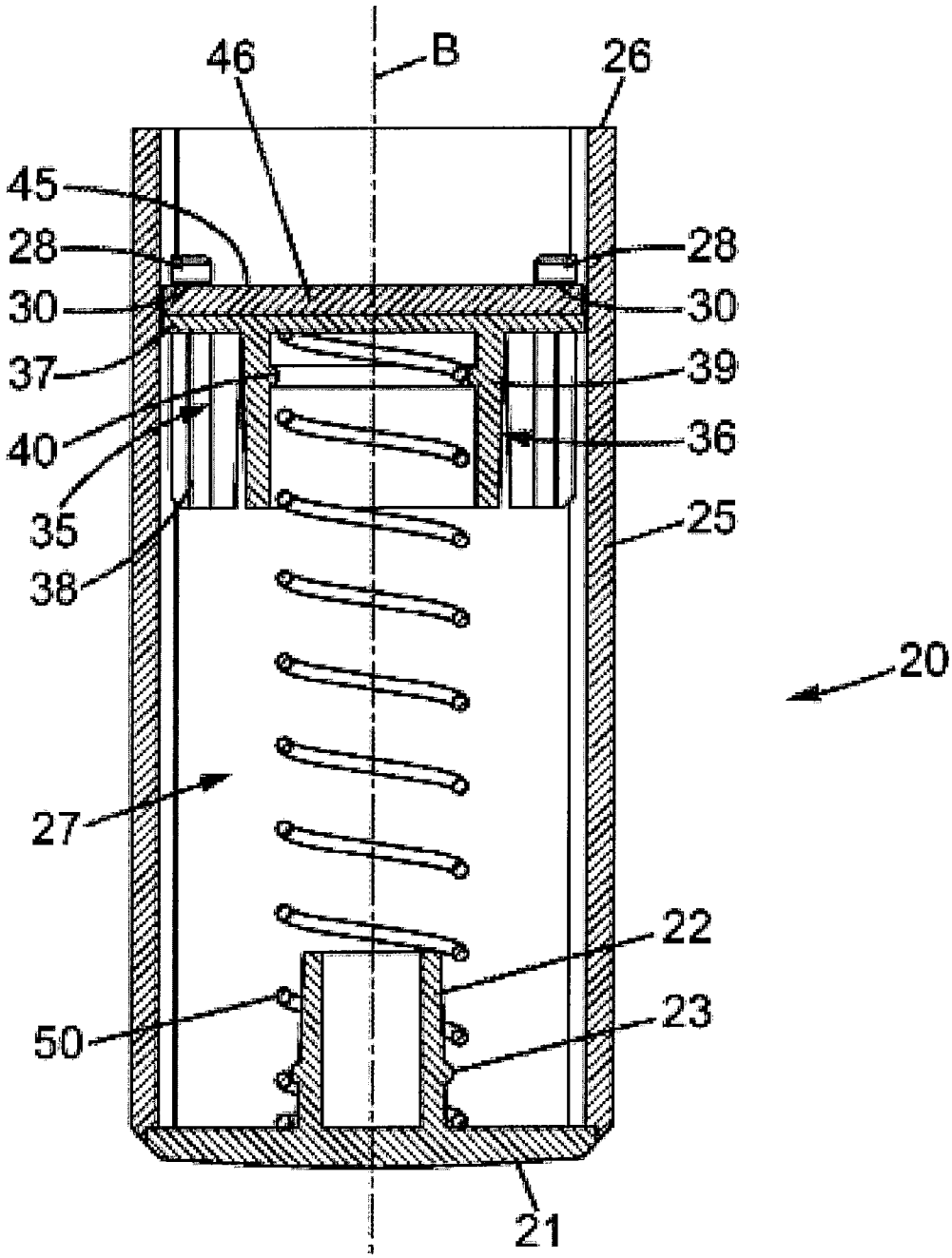
FIG. 3 is a cross-sectional view along the line marked II-II in FIG. 1 of the lipstick case in FIG. 1, showing the mirror in a position of use.
Figure 4:
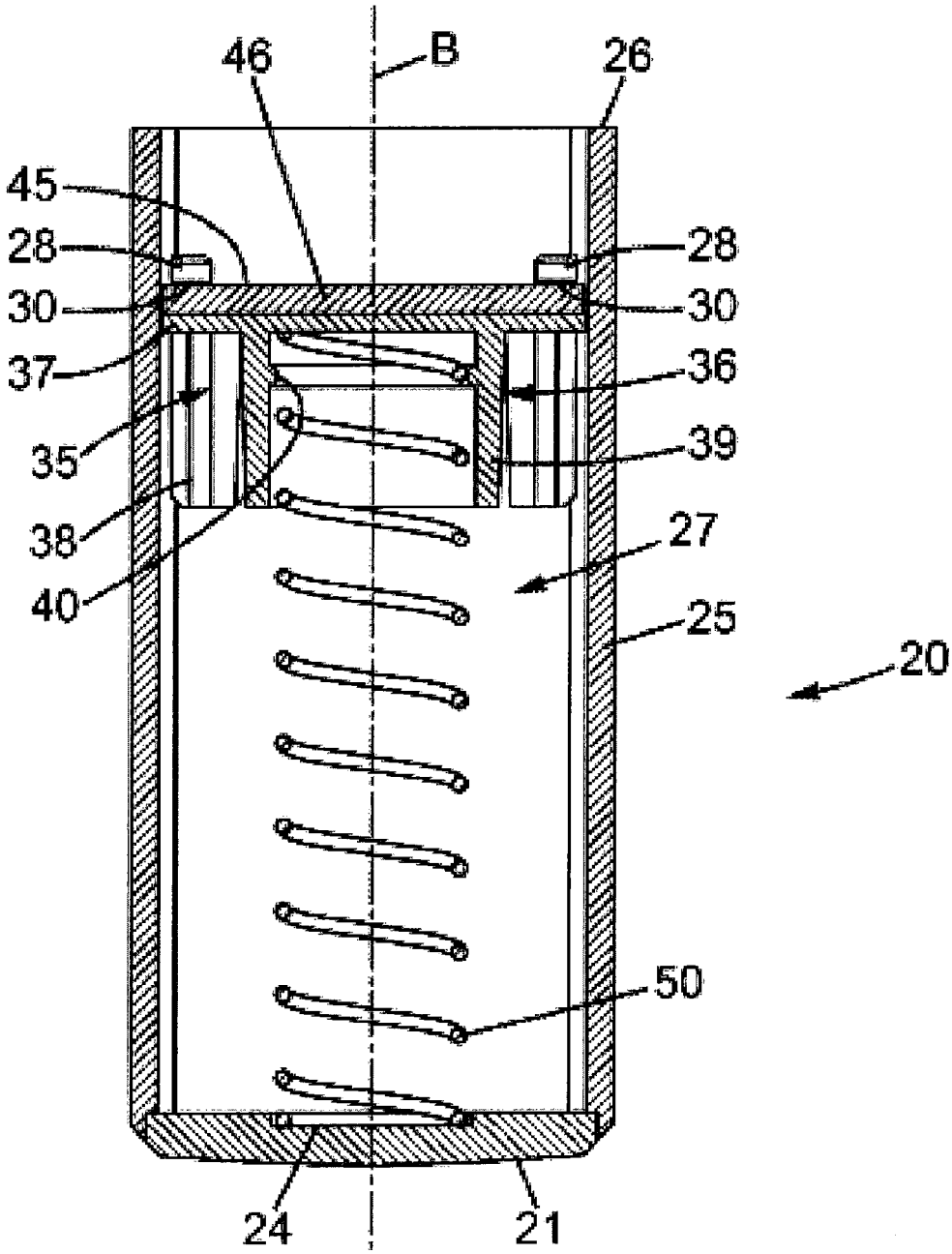
FIG. 4 is a similar view to FIG. 3, showing a variant of the embodiment of a seat for a spring elastically urging the mirror towards the position of use.

As shown in FIGS. 1 and 3, the case 20 comprises inside the housing 27 one or more stops 28 protruding from the side wall 25. For example, four rigid stops 28, made in a single piece with the side wall 25, can be arranged at each corner of the housing 27, near the opening of the case 20. Each stop 28 has a substantially transverse inner surface relative to the central axis B, opposite the bottom 21. The lower surfaces of the stops 28 form an abutment surface 30 aimed at limiting the movement of the mobile member 35 in the housing 27 towards the opening.

In FIGS. 2 and 3, the mobile member 35 comprises a support 36 and a mirror 46.

The support 36 comprises a rectangular plate 37 from a face of which feet 38 and a centred guide sleeve 39 extend perpendicularly. The guide sleeve 39 is suitable for surrounding the guide skirt 22 of the case 20 and has inwardly an annular retaining bead 40.

The mirror 46 is fixed to the plate 36, on the face opposite the feet 38 and the guide sleeve 39.

The support 36 is mounted between the bottom 21 of the case and the stops 28 so that the plate 37 and the mirror 46 extend perpendicular to the central axis B, the mirror 46 itself facing towards the opening of the case 20 and the feet 38 and the guide sleeve 39 facing towards the bottom 21 of the case.

In the embodiment shown in FIGS. 2 and 3, an elastic member in the form of a compression spring 50, with a determined unloaded length and stiffness, is mounted between the bottom 21 and the mobile member 35. In particular, one of the ends of the spring 50 is fitted onto the guiding skirt 22 of the bottom 21 of the case and the other end is fitted into the guide sleeve 39 of the support. The guide skirt 22 and the guide sleeve 39 form seats on which the compression spring 50 is held by means of the retaining beads 23, 40. Advantageously, according to one embodiment, a conical or double conical spring is used in order to save as much space as possible.

The support 36 can then be moved inside the housing 27 along the central axis B between a retracted position, shown in FIG. 2, and a position of use, shown in FIGS. 1 and 3.

The position of use is defined by the abutment surface with which the mobile member comes into contact under the effect of the compression spring 50.

In particular, the compression spring 50 elastically urges the support 36 towards the position of use, in which the mobile member 35 is away from the bottom 21 and pressed against the stops 28, the mirror 46 thus being close to the opening of the case 20. The stops 28 are arranged at a distance from the bottom 21 that is strictly shorter than the unloaded length of the compression spring 50 to ensure that the mobile member 35 abuts against the abutment surface 30 formed by the stops 28 in the position of use.

As shown in FIG. 2, the mobile member 35 is near the bottom 21, in the retracted position, when the case 20 is placed on the applicator device. In particular, provision can be made for the free end 17 of the sheath to press on the mirror 46 against the force of the compression spring 50 to return and hold the mobile member 35 in the retracted position.

In the first embodiment shown in FIGS. 1 to 3, the mobile member 35 is mounted in the housing 27 opposite the opening before the bottom 21 is positioned. However, provision could be made for other embodiments of the stops, for example in the form of flexible tabs extending axially towards the bottom 21, allowing for the mobile member 35 to be mounted through the opening.

Further changes can be made to the applicator device, the case 20 or the mobile member 35. For example, in a variant shown in FIG. 4, the seat of the compression spring 50 on the bottom 21 of the case is formed by a recess 24.

Moreover, in other embodiments, the compression spring 50 can be replaced by any actuating member, particularly of a cylinder or other type, suitable for forcing the mobile member 35 towards the position of use.

The second embodiment of the lipstick is described with reference to FIGS. 5 to 10.

As for the first embodiment, the lipstick according to the second embodiment comprises the applicator device described above together with a case 20 and a mobile member 35 similar to those described above.

However, the second embodiment differs from the first embodiment mainly in the form taken by the abutment surface 30 with which the mobile member 35 is in contact in the position of use.

In the second embodiment, the support 36 shown in FIG. 7 comprises two base walls 41 that extend perpendicularly from two opposite sides of the plate 37. Two elastically deformable tabs 42 are formed on the base walls 41 by cut-outs in the base walls 41. The tabs 42 extend generally perpendicular to the plate 37 to a free end near the plate 37. The tabs 42 are elbowed so that the free ends are pointing outwards away from the rest of the base walls 41.

Figure 6:
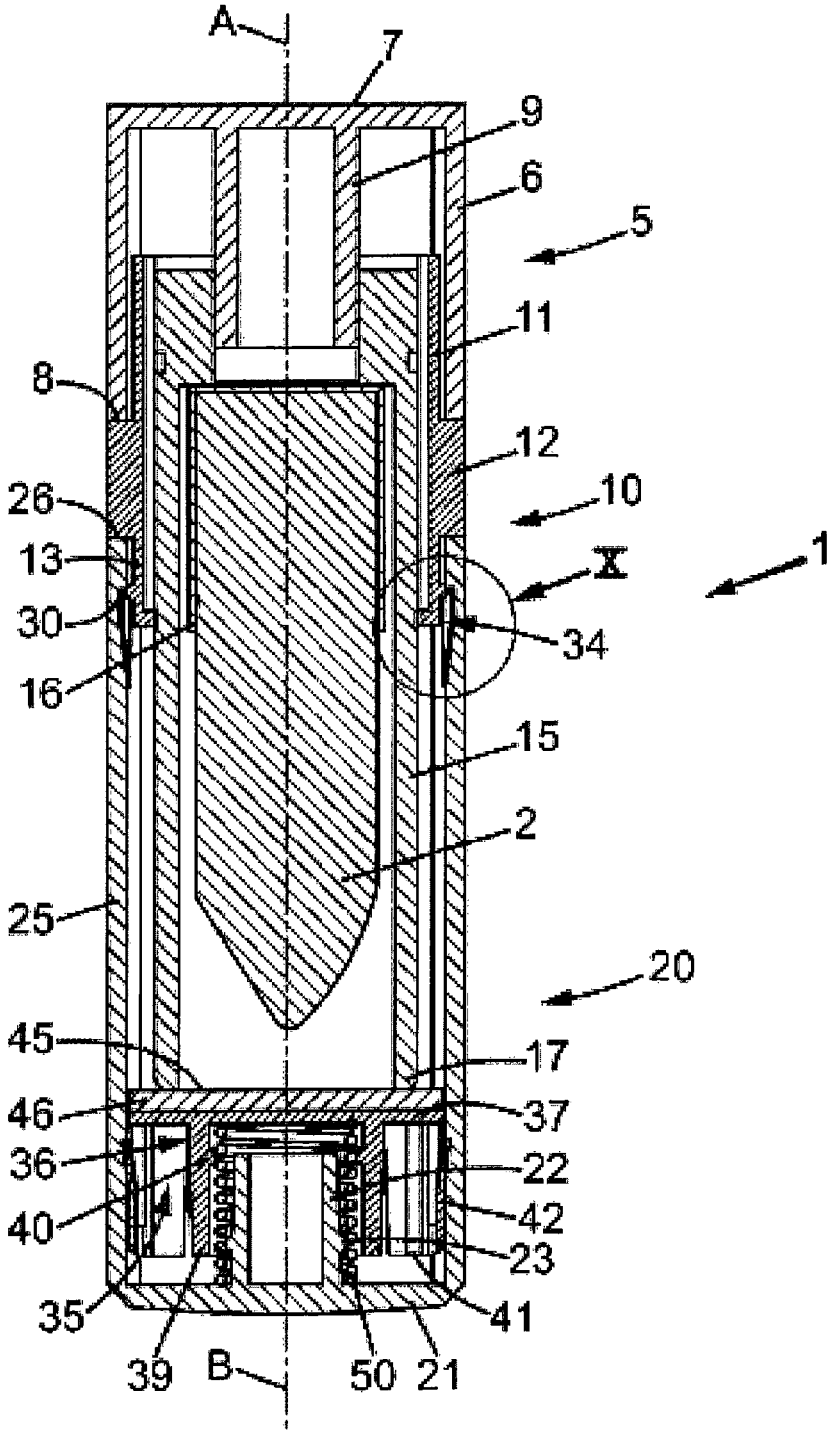
FIG. 6 is a cross-sectional view along the line marked VI-VI in FIG. 5 of the lipstick in FIG. 5, showing the mirror in the retracted position.

Once the support 36 has been placed in the housing 27, as shown in FIG. 6, the tabs 42 extend generally along the central axis B towards the opening, the free ends coming into contact with the inner surface of the side wall 25. The tabs 42 thus form guide elements ensuring the guidance and smooth movement of the support 36 in the housing 27 due to the friction of the free ends on the inner surface of the side wall 25.

As a variant, the support 36 could comprise one or more of two guide elements in any appropriate form.

Figure 8:
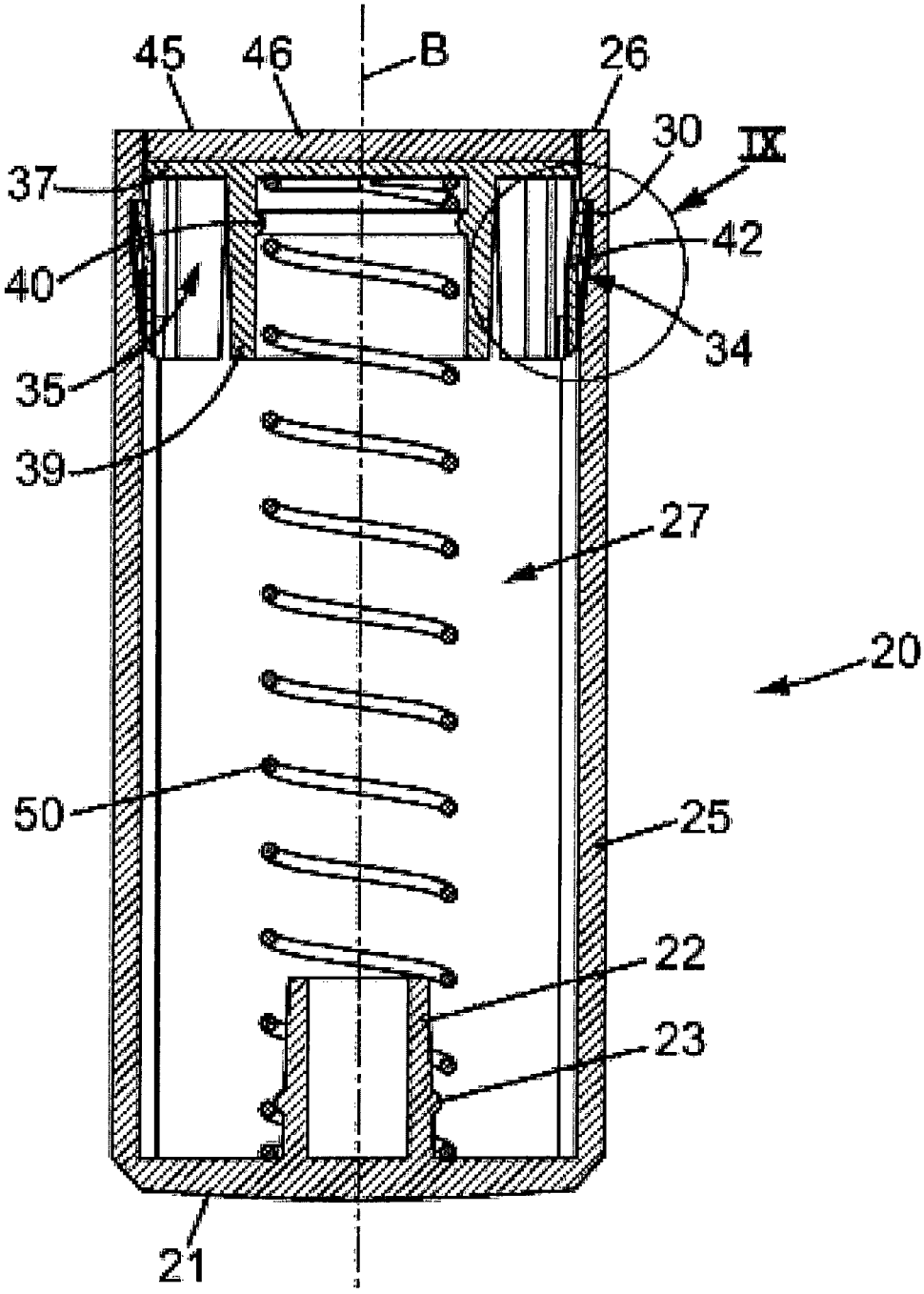
FIG. 8 is a cross-sectional view along the line marked VI-VI in FIG. 5 of the lipstick case in FIG. 5, showing the mirror in the position of use.

In FIGS. 8 and 9, the case 20 comprises inwardly two recesses 34 formed in two opposite sides of the side wall 25. Each recess 34 has a substantially transverse surface relative to the central axis B, facing the bottom 21 and placed near the opening of the case 20. The transverse surfaces of the recesses 34 form the abutment surface 30 against which the mobile member 35 abuts in the position of use.

In particular, when the support 36 reaches the position of use, the tabs 42, due to their elasticity, extend into the recesses 34 and the free ends come into contact with the abutment surface 30. The tabs 42 and the abutment surface 30 can be arranged so that the mirror 46 is flush with the free edge 26 of the case in the position of use.

According to this second embodiment, any type of glass mirror can be used, in particular those with a substantially flat surface, typically concave, in order to obtain optical effects, typically magnification, of the area to which the product is to be applied.

As shown in FIG. 10, the fitting portion 13 of the applicator device then also comprises a securing element, such as an elastically deformable bead 14, arranged to click into the recess 34 when the applicator device is received in the housing 27 of the case. The case 20 is thus held on the applicator device, the mobile member 35 being in a retracted position as explained above.

In the second embodiment, the mobile member 35 can be mounted in the housing 27 through the opening. The bottom 21 of the case can therefore be made in a single piece with the side wall 25.

Figure 12:
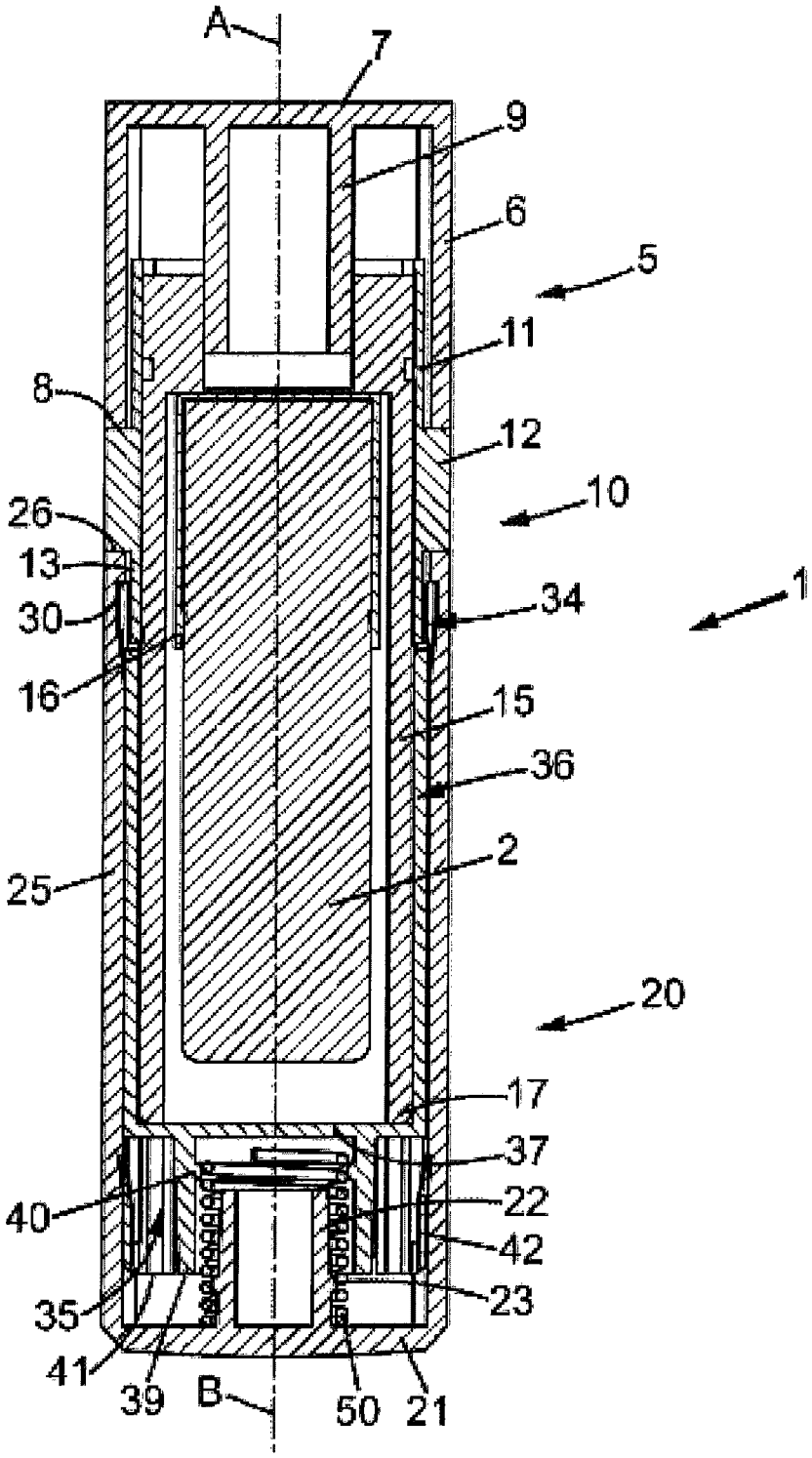
FIG. 12 is a cross-sectional view along the line marked XII-XII in FIG. 11 of the lipstick in FIG. 11, showing the mirror in the retracted position.

A third embodiment of the lipstick is shown in FIGS. 11 and 12.

The lipstick according to the third embodiment comprises the applicator device and the case 20 described above in relation to the second embodiment, together with a mobile member 35 similar to that described above in relation to the second embodiment.

In particular, as shown in FIG. 12, the support 36 of the lipstick according to the third embodiment comprises one or more tabs 42 in contact with the inner surface of the side wall 25 of the case to guide its movement and abut against the stop surface 30 of one or more recesses 34 made in the side wall 25 in the position of use.

The lipstick according to the third embodiment differs from the lipstick according to the second embodiment mainly in the form of the support 36 and the arrangement of the mirror 46.

The support 36 comprises a tubular side wall 43 with a rectangular cross-section that extends along the central axis B from the transverse plate 37. The side wall 43 and the plate 37 define a cylindrical receiving space 44 open on the side of the opening in the case 20 and suitable for receiving the sheath 15 of the applicator device when the case 20 is placed over the applicator device.

In order to increase the dimensions of the reflective surface 45, the mirror 46 is fixed to an outer surface of the support 36 and extends parallel to the central axis B.

As shown in FIG. 11, in the position of use, the majority of the mirror 46 comes out of the case, which improves the visibility of the reflective surface 45. With such an arrangement of the mirror 46, elements suitable for wiping the mirror 46 during the movement of the support 36 can be provided on the side wall 25.

FIG. 13 shows a variant of the third embodiment in which the mirror 46 parallel to the central axis B is fixed to the support 36 without a side wall. The mobile member 35 is then generally L-shaped.

In the embodiments shown, the dispenser 1, and in particular the base 5, the case 20 and the support 36, has a generally rectangular cross-section. The invention is not however limited to such a cross-section.

Figure 14:
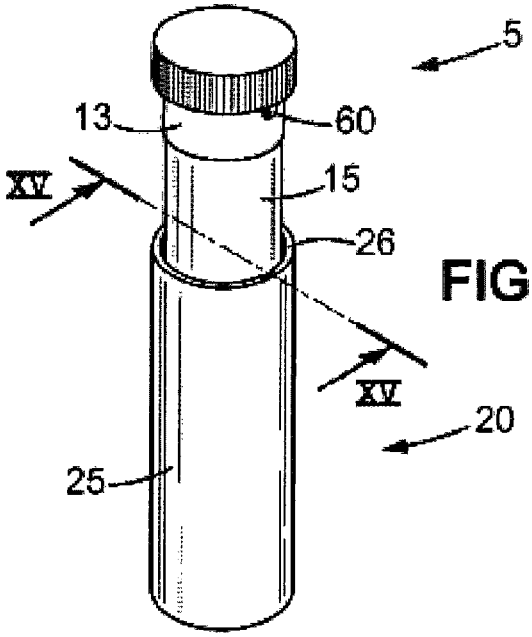
FIG. 14 is a perspective view of a variant of the lipstick in FIG. 5, in which the lipstick has a circular cross-section.
Figure 15:
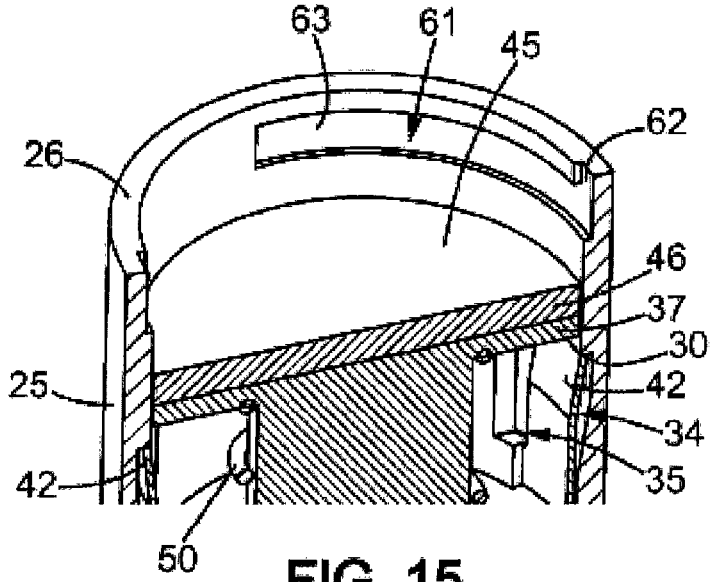
FIG. 15 is an enlarged cross-sectional view along the line marked XV-XV in FIG. 14 of a portion of the lipstick in FIG. 14.

Provision can be made for example, in a variant shown in FIGS. 14 and 15, for the cross-section of the dispenser to be generally circular.

In the dispenser 1 in FIGS. 14 and 15, shown as a variant of the second embodiment described above but transposable to the other embodiments, members for locking the applicator device to the case 20 are provided.

These locking members comprise for example two stubs 60 formed on the fitting portion 13, and two L-shaped grooves 61 formed in the inner surface of the case 20 and opening onto the free edge 26 of the case. Each L-shaped groove 61 has a transverse part 63 extending from an axial part 62 substantially over a quarter of the circumference of the case 20.

The applicator device is locked to the case 20 by inserting the stubs 60 into the L-shaped grooves 61 via the axial parts 62 and rotating the applicator device a quarter of a turn relative to the case 20.

The invention claimed is:

1. A dispenser of product, particularly for cosmetics, comprising:

an applicator device suitable for applying said product, said applicator device extending along an axis, a case comprising a housing that extends longitudinally along a central axis between a closed bottom and an opening for access to the housing opposite the bottom, said housing being suitable for coaxially receiving at least a portion of the applicator device, the case comprising a tubular side wall delimiting the housing transversely relative to the central axis, a mobile member provided with a mirror, the mobile member being movably mounted inside the housing along the central axis between a retracted position, in which said mobile member is close to the bottom, and a position of use, in which said mobile member is apart from the bottom, an actuating member mounted between the bottom of the case and the mobile member, and suitable for urging the mobile member towards the position of use, wherein the housing comprises an abutment surface suitable for cooperating with the mobile member to define the position of use of said mobile member, and wherein the case comprises inwardly at least one recess formed on the side wall, said recess containing the abutment surface, and in that the mobile member comprises at least one guide element configured to be in contact with an inner surface of the case and to be in contact with the abutment surface in the position of use of the mobile member, the guide element being an elastically deformable tab extending along the central axis towards the opening to a free end in contact with the inner surface of the case, said free end being in contact with the abutment surface in the position of use of the mobile member.

2. The dispenser according to claim 1, wherein the abutment surface is arranged substantially transversely relative to the central axis so as to be in contact with the mobile member in the position of use.

3. The dispenser according to claim 1, wherein the applicator device comprises a securing element suitable for clicking into the recess when the applicator device is received in the housing of the case.

4. The dispenser according to claim 1, wherein the mirror extends perpendicular to the central axis.

5. The dispenser according to claim 1, wherein the mirror extends parallel to the central axis.

6. The dispenser according to claim 5, wherein the mobile member comprises a support having a receiving space that extends along the central axis, said receiving space being open on the side of the opening of the case to receive the applicator device, said support having an outer surface holding the mirror.

7. The dispenser according to claim 1, wherein the applicator device comprises a solid or paste product designed to be applied to the lips in the context of cosmetic or pharmaceutical use.

8. The dispenser according to claim 1, wherein the applicator device comprises a cosmetic product for the care and/or make-up of the lips.

9. The dispenser according to claim 8, wherein the product is a lipstick stick.

* * * * *